US007002072B2

(12) United States Patent
Tonucci et al.

(10) Patent No.: US 7,002,072 B2
(45) Date of Patent: Feb. 21, 2006

(54) HIGH VOLTAGE, HIGH TEMPERATURE WIRE

(75) Inventors: Ronald J. Tonucci, Waldorf, MD (US); Gary Roan, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/868,446

(22) Filed: Jun. 14, 2004

(65) Prior Publication Data

US 2004/0222010 A1 Nov. 11, 2004

Related U.S. Application Data

(63) Continuation-in-part of application No. 10/326,962, filed on Dec. 20, 2002, now abandoned.

(51) Int. Cl.
*H01B 7/34* (2006.01)

(52) U.S. Cl. ..... 174/36

(58) Field of Classification Search ..... 174/36, 174/110 R, 113 R, 110 A, 110 PM, 120 R, 174/120 SC, 121 R, 122 R, 122 G, 124 G, 174/124, 126.1

See application file for complete search history.

(56) References Cited

U.S. PATENT DOCUMENTS 4,495,691 A * 1/1985 Masumoto et al. ..... 29/527.5
4,620,432 A * 11/1986 Stepanenko et al. ..... 72/73
5,139,820 A * 8/1992 Sawada et al. ..... 427/120
5,431,800 A * 7/1995 Kirchhoff et al. ..... 204/403.01
5,436,409 A * 7/1995 Sawada et al. ..... 174/120 C
6,060,162 A * 5/2000 Yin et al. ..... 428/372
6,441,737 B1 * 8/2002 Antonenco et al. ..... 340/572.1
6,556,139 B1 * 4/2003 Manov et al. ..... 340/572.6

FOREIGN PATENT DOCUMENTS

GB 2284267 A * 5/1995

OTHER PUBLICATIONS

Manov et al., "Influence of the treatment of melt on the properties of amorphous materials; ribbons, bulks and glass coated microwires," Materials Science & Engineering, 2001, pp. 54-60, vol. A304-306.

* cited by examiner

*Primary Examiner*—William H. Mayo, III
(74) *Attorney, Agent, or Firm*—John J. Karasek; L. George Legg

(57) ABSTRACT

An insulated conducting wire (ICW) having an inorganic cladding and a microwire positioned within the cladding. The outer diameter of the microwire is less then the inner diameter of the cladding, and the insulated conducting wire is substantially free of bonding between the microwire and the cladding. A process of making a wire, having the steps of: drawing an inorganic tube through a heating zone such that the inner diameter of the tube is reduced; inserting a microwire into the tube whereby the tube becomes a cladding; and adjusting the draw process parameters such that the inner diameter of the cladding is larger than the outer diameter of the microwire, and the microwire and the cladding are not in contact with each other under thermal conditions that would cause bonding between the microwire and the cladding.

40 Claims, 3 Drawing Sheets

HIGH VOLTAGE, HIGH TEMPERATURE WIRE

This application is a continuation-in-part application of U.S. patent application Ser. No. 10/326,962 to Tonucci et al., filed on Dec. 20, 2002, now abandoned, the entire file wrapper of which is incorporated herein by reference.

BACKGROUND OF THE INVENTION

1. Field of the Invention

The invention relates generally to insulated conducting wires (ICW) having a gap between a microwire and a cladding, and processes for making the same.

2. Description of the Prior Art

The Taylor process is a method of a making a very fine wire, referred to as a microwire. The microwire is encased in a cladding. The process is described in Donald et al., "The preparation, properties and applications of some glass-coated metal filaments prepared by the Taylor-wire process," *J Mat. Sci.,* 31, 1139 (1996). The metal to be made into a microwire is contained in a glass tube which is closed at one end. The metal is then melted and the end of the glass tube softened and drawn down to produce a fine glass-encapsulated metal filament. A limitation of this method is that the metal microwire is in contact with the glass. This prevents the wire from being useful at high temperatures because the metal can diffuse into the glass, reducing the insulating, electrical, and mechanical properties of the glass. A further limitation is that the glass must be drawn at above the melting point of the metal.

There are known inorganic cladded metal wires which are capable of conducting electricity under high voltages and high temperatures such as 1000 V and 500° C. For example, a Pyrex coated stainless steel wire, typically used in photocopy machines. Another example is a glass coated gold wire that can be made as small as 600 nm in diameter. However, such wires are not flexible and tend to be brittle, primarily due to the insulating coating. They cannot be fabricated in long lengths either. Flexibility is a required characteristic for certain applications such as decoy towlines. The best flexible ICW is able to perform up to only 400° C. and contains a flexible organic insulating coating which decomposes over time at high temperatures. An example of such an ICW is a copper wire coated with polyimide.

There remains a need for a flexible wire at least 30 centimeters in length that is capable of conducting at 1000 V and 500° C.

SUMMARY OF THE INVENTION

The invention comprises an ICW comprising: a metal microwire having an outer diameter; and an inorganic cladding having an inner diameter. The outer diameter of the microwire is at least about 2 microns less then the inner diameter of the cladding and the microwire is positioned within the cladding. The insulated conducting wire is substantially free of bonding between the microwire and the cladding.

The invention further comprises a process of making an ICW, comprising the steps of: providing a metal microwire having an outer diameter; providing an inorganic tube having an inner diameter larger than the outer diameter of the microwire; drawing the tube through a heating zone at draw process parameters such that the inner diameter of the drawn portion of the tube is reduced; inserting the microwire into the drawn portion of the tube, whereby the drawn portion of the tube becomes a cladding around the microwire; and adjusting the draw process parameters such that the inner diameter of the cladding is larger than the outer diameter of the microwire, and the microwire and the cladding are not in contact with each other under thermal conditions that would cause bonding between the microwire and the cladding.

DETAILED DESCRIPTION OF THE PREFERRED EMBODIMENTS

Figure 1:
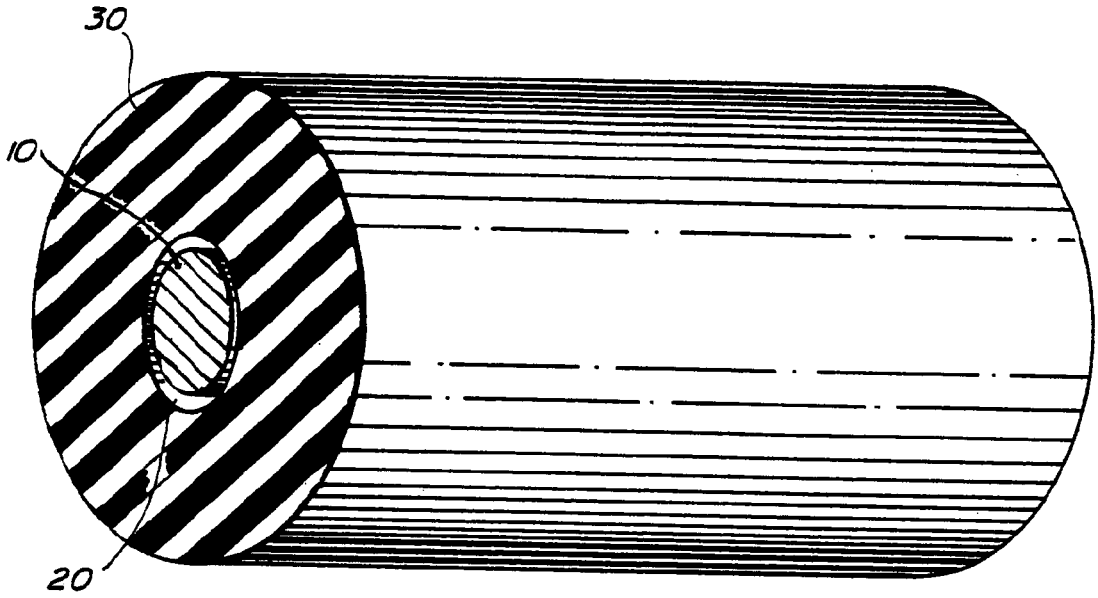
FIG. 1 is a schematic cross-sectional representation of an embodiment of the ICW of the invention.

The method of the invention comprises several steps. In the step of providing a metal microwire, the microwire is a very thin metal wire. Such microwires are known in the art. Microwires inherently have an outer diameter. The maximum outer diameter of microwires is generally considered to be about 1000 $\mu$m. Microwires with outer diameters as small as 1–10 $\mu$m or less are also known. Microwires are commercially available in a variety of metals and diameters, although the invention is not limited to commercially available microwires.

Examples of microwires suitable for the invention can have outer diameters in the range of, but not limited to, about 1 $\mu$m to about 250 $\mu$m. The microwire can comprise any solid metal. The microwire can also comprise an alloy or other combination such as a coating of one metal on another metal or a composite of two or more dissimilar metals. One possible composite structure is a core-clad structure. This may be made by inserting a rod of one metal into tube of another metal. The microwire than comprises the core-clad composite. An advantage of the core-clad composite is that the core can be a cheap, more electrically conductive or lower melting point metal such as silver or copper. The cladding can be a more expensive metal that resists oxidation, such as platinum or a metal with a higher melting point such as tungsten, molybdenum, iridium, or rhenium. Suitable metals for the microwire can include, but are not limited to, one or more metals selected from the group consisting of copper, silver, gold, platinum, tungsten, molybdenum, rhenium, rhenium/platinum alloy, high temperature metals, and alloys and composites thereof.

In the step of providing an inorganic tube, the tube is a hollow cylinder. The cylinder inherently has an inner diameter. Inorganic tubes are commercially available in a variety of inorganic materials and diameters, although the invention is not limited to commercially available tubing. The tube may also comprise different materials in different areas of the tube. For example, the tube may have a "starter" zone at one end that comprises a material useful for beginning the drawing process, while the rest of the tube comprises the desired insulating material. The tube may also be a graded seal material, where there is a gradient of the composition of the tube along the length of the tube. In these cases, the softening point of the tube may vary along the length of the tube. This may allow or require changing the draw process parameters during the course of the drawing.

Examples of tubes suitable for the process of the invention can have inner diameters in the range of, but not limited to, about 0.25 in to about 1.5 in. The inner diameter is larger than the outer diameter of the microwire. The thickness of the tube is chosen by reference to the desired thickness of the cladding. The ratio of the inner and outer diameters of the cladding may be about the same as the ratio of the inner and outer diameters of the tube. The major limitation on the size of the tube is the ability of the drawing equipment to reduce inner diameter of the tube to the appropriate size. The tube comprises an inorganic material which has a softening temperature that can be, but is not limited to, lower than the melting point of the metal. Suitable inorganic materials can include, but are not limited to, one or more materials selected from the group consisting of fused silica, fused quartz, alumina, a glass, and combinations thereof. Fused silica in highly pure form is a particularly strong material with excellent dielectric, thermal, and mechanical properties.

In the step of drawing the tube, the tube is drawn through a heating zone in a manner similar to the way optic fibers are reduced in diameter, at draw process parameters such that the inner diameter of the drawn portion of the tube is reduced to about the same size as the outer diameter. The draw process parameters can include, but are not limited to, heating zone temperature and profile, drawing speed, feed speed, atmosphere, and tube material. The tube is softened within the heating zone, and stretched during the drawing process. This makes the tube narrower and reduces the inner diameter. An inert atmosphere may be used to avoid metal oxidation and reduce the number of hydroxyl groups that could weaken the properties of the cladding material.

After a portion of the tube has been drawn, the microwire is inserted into the tube. The insertion is done such that continued drawing of the tube will also pull the microwire. The insertion may comprise contacting the microwire to the inside of the drawn tube by adjusting the draw process parameters to further reduce the inner diameter of the drawn portion of the tube. The inserting step may also be performed before or simultaneously with the drawing step, although the microwire may not be immediately pulled with the tube. The microwire may also have a leader portion on the end inserted into the tube. The leader may be a wire that can withstand higher temperatures than the microwire. The use of a leader may allow for heating the tube to a higher temperature such that it can be baited-off rapidly. Once the process parameters have been set, the leader can end and the microwire can be drawn into the tube. The leader may be attached to the microwire by any means, and may even be attached while the process is running. The portion of the drawn tube that surrounds the microwire is then referred to as a cladding.

In the adjusting step, the draw process parameters are then adjusted such that the inner diameter of the cladding is larger than the outer diameter of the microwire. This results in a gap between the microwire and the cladding all the way around the microwire. This gap is present at all points along the wire where the thermal conditions would cause bonding between the microwire and the cladding. If the cladding temperature is too high, such as when the glass is softened, the hot cladding may bond to the microwire if they were allowed to touch. By keeping the microwire centered or concentric within the larger cladding while they are hot, bonding can be prevented. When the cladding and microwire are sufficiently cool, it is no longer necessary to maintain the gap all the way around the microwire. The cooled microwire may then touch the cooled cladding without causing bonding.

The size of the gap can be controlled by appropriate adjustment of the draw process parameters. If the inner diameter was about the same as the outer diameter in the drawing step or the inserting step, then the drawing speed would be reduced in the adjusting step. The reduction in drawing speed increases the inner diameter of the cladding. If the gap is too large during the drawing step, the drawing speed would be increased. If the gap is already the desired size, then the adjusting step can comprise maintaining the draw process parameters as they were during the drawing step or the inserting step. The cladding can have an inner diameter in the range of, but not limited to, about 3 $\mu$m to about 290 $\mu$m. The difference in diameters may be, but is not limited to, from about 2 $\mu$m to about 40 $\mu$m. The adjusting step may also comprise a change of tube material, as when the tube is not homogenous, such as a graded seal.

Once the adjustment has been done, the draw process parameters can be maintained while more microwire and tube is fed into the heating zone, producing a continuous length of wire without any bonding between the microwire and the cladding. The result can be an ICW comprising a metal microwire and an inorganic cladding. The microwire is positioned within the cladding and the outer diameter of the microwire is less then the inner diameter of the cladding. The microwire and the cladding are substantially not bonded to each other. Bonding refers to any molecular or atomic level force that holds the microwire and the cladding together. Bonding also refers to a substantial detrimental change in the chemical, thermal, or mechanical properties of the wire or cladding as a result of contact at temperatures that cause such changes, even if the contact is only temporary. Bonding does not refer to mere touching or mechanical forces, such as when the cooled wire is in a configuration that presses the microwire and the cladding together and friction makes sliding one against the other difficult. The term "substantially" indicates that there is a portion of wire that is free of bonding for at least a length that is useful for applications requiring an insulated conducting microwire. Suitable portions include, but are not limited to, at least about 1 cm, at least about 30 cm, at least about 10 m, at least about 400 m, and at least about 600 m. Some bonding is within the scope of the claimed wire if it is limited to defects or portions that are intended to be cut from the wire to be used. For example, a length of wire may include a leader portion with bonding that is to be cut off before use. There may be bonding at intervals, either intentionally or due to defects, if these bonded areas may be cut out, yielding usable portions of wire that are free of bonding.

The drawing temperature is not necessarily restricted by the melting point of the metal in the microwire. The microwire should not melt during the process. This is easily done at temperatures below the melting point of the metal. This can also be done at higher temperatures by pulling the microwire through the heating zone fast enough that is does not have time to melt before returning to lower temperatures. When the microwire comprises a core-clad composite, it may only be necessary to avoid melting the cladding, while allowing the core to temporarily melt during the drawing process.

FIG. 1 schematically illustrates the cross-section of an embodiment of the wire. The microwire 10 is surrounded by the cladding 30. There is a gap 20 between the microwire 10 and the cladding 30.

Figure 2:
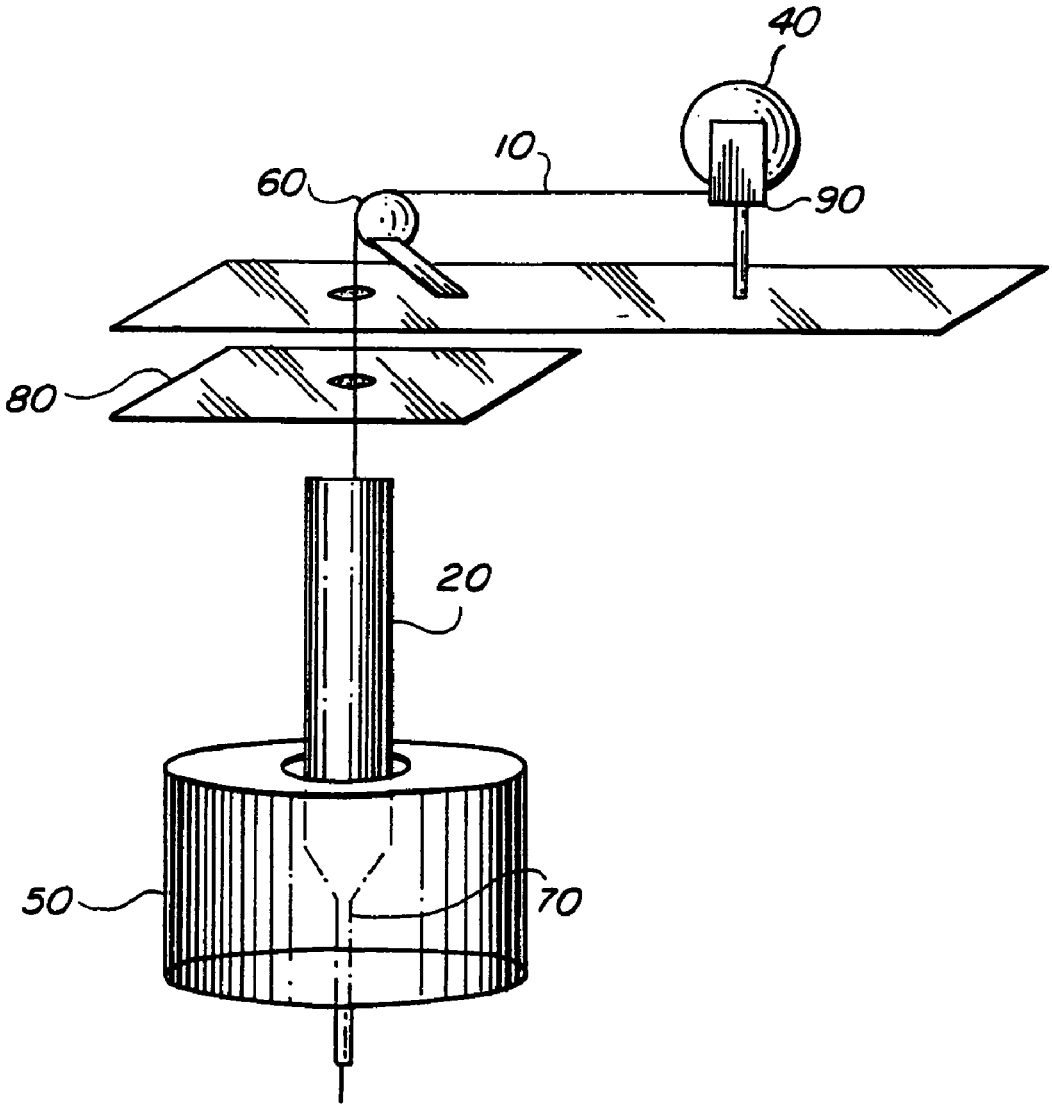
FIG. 2 is a schematic illustration of an embodiment of an apparatus capable of making the a ICW of the invention.

FIG. 2 schematically illustrates an embodiment of an apparatus known as a draw tower capable of making the wire of the invention. The microwire 10 is supplied on a spool 40 at the top of the draw tower. The tube 20 is drawn through a furnace 50 and narrowed to a drawn tube 70. The microwire 10 passes through an x-y translator 60 to correctly position it in the center of the drawn tube 70. The microwire 10 remains approximately centered in and not touching the drawn tube 70 for the entire length inside the furnace 50, and for any further length needed for the glass and metal to cool enough to prevent bonding. An insulating plate 80 protects the spool 40 from the heat of the furnace 50. A tensioning device 90 on the spool 40 keeps the microwire 10 straight and taught. Arbitrarily long wires, such as 200 meters, 400 meters, 4000 meters, or longer, can be made with a draw tower.

The ICW can also be made in shorter lengths with lab-scale apparatus. This may be done by simply inserting the microwire into an inorganic cladding that already has the desired final inner diameter. No drawing or heating is necessary for this method. The ICW of the invention may also be made by other methods.

The ICW may be suitable as a general purpose ICW. At least some embodiments of the insulated conducting wire have properties that are not available in any other insulated conducting wire. Due to the small diameter, the ICW may be flexible. As used herein, the term "flexible" refers to the ability to bend the ICW according to methods known in the art. It is also possible to manufacture the ICW in long lengths of at least 30 cm and up to 400 meters and longer. The wire may be capable of conducting current while subjected to a potential of at least about 1000 V and a temperature of at least about 500° C. without dielectric breakdown. The wire may withstand even more severe conditions such as 5000 V at 840° C. or 1,000° C., 10,000 V at 650° C., and 1000 V at 1500° C.

The presence of the gap during the draw process may be responsible for the high temperature, high voltage properties of the ICW. The following descriptions of the mechanism by which the gap improves the performance of the ICW are proposed mechanisms. The proposed mechanisms do not limit the scope of the invention. The gap may help to offset the effects of differential thermal expansion of the microwire and the cladding. If the microwire and the cladding were bonded together or physically attached, thermal expansion could cause fracture or failure of the cladding. When there is no bonding between them, each can expand without being constrained by the other. This can also be the basis for maintaining the flexibility of the wire.

The gap may also avoid contact and diffusion of metal onto and/or into the cladding during the drawing process. The drawing process may take place at temperatures high enough that any metal in contact with the cladding may stick onto and/or diffuse into the cladding. Such metal contamination can adversely affect the physical and electrical properties of the cladding. The cladding may lose strength as well as dielectric properties. Since the gap is present during the drawing process, there is no metal in contact with the cladding while at elevated temperatures and therefore minimal to no metal diffusion. Prevention of contamination is particularly important where the cladding is fused silica, as its mechanical and dielectric properties are very sensitive to contamination. Once wire has cooled, there may be contact between the microwire and the cladding without bonding. This may not adversely affect either the mechanical or electrical properties of the wire.

Certain contaminants in the silica may by useful. Fused silica doped with 4+ ions such as $Ti^{4+}$ and $Ce^{4+}$ can have a lower softening point and can make the glass mechanically stronger. The doping level may be less than 0.2%. The softening point can be reduced from over 2000° C. to about 1600° C. This may be useful when the microwire comprises molybdenum, as molybdenum can become brittle when heated to 2000° C. These ions have very little mobility so there is minimal reduction in dielectric and mechanical strength. A similar effect may be achieved with phosphorous doped silica. Other suitable materials include, but are not limited to, a doped glass and $F^-$ doped silica.

The properties of the ICW may make it suitable for use in a decoy towline. A decoy towline is used to tow a decoy behind a military aircraft. The towline can comprise a number of components, including conducting wire that should be flexible, light-weight and capable of functioning at high voltages and high temperatures. The towline should have as small a diameter as possible, so that it can be wound onto a spool and take up little space. When the towline passes through the jet engine plume, it is subject to extreme temperatures. The wire of the invention may still continue to perform as needed under these conditions.

The cladding can be strengthened by placing a coating on its surface. The coating can comprise, but is not limited to, one or more materials selected from the group consisting of polyimide, a polymer, an organic coating, and an inorganic coating. The coating may allow the ICW to be handled after the drawing process without breaking the wire. The ICW may be wound onto a spool, incorporated into a device, or otherwise handled. The coating may both strengthen the ICW and protect the cladding from scratching and from materials that may contaminate the cladding.

The coating may not be necessary to the electrical properties of the wire. In a decoy towline, the coating may be polyimide. The polyimide can protect the wire when the wire is spooled, unwound, incorporated into the towline, and deployed. Once the towline is deployed and exposed to the jet engine plume, the polyimide may decompose and expose the cladding. However, the polyimide is not needed to obtain the electrical properties needed for the wire in the towline and is not needed for strength once the towline is deployed. Polyimide decomposes cleanly. The decomposition products may not contaminate the cladding.

Having described the invention, the following examples are given to illustrate specific applications of the invention. These specific examples are not intended to limit the scope of the invention described in this application.

EXAMPLE 1

Copper-silica wire—An ICW composed of a copper microwire and a polyimide coated silica cladding was made by feeding the microwire into a fused silica tube (360 micron outer diameter, 100 micron inner diameter).

Figure 3:
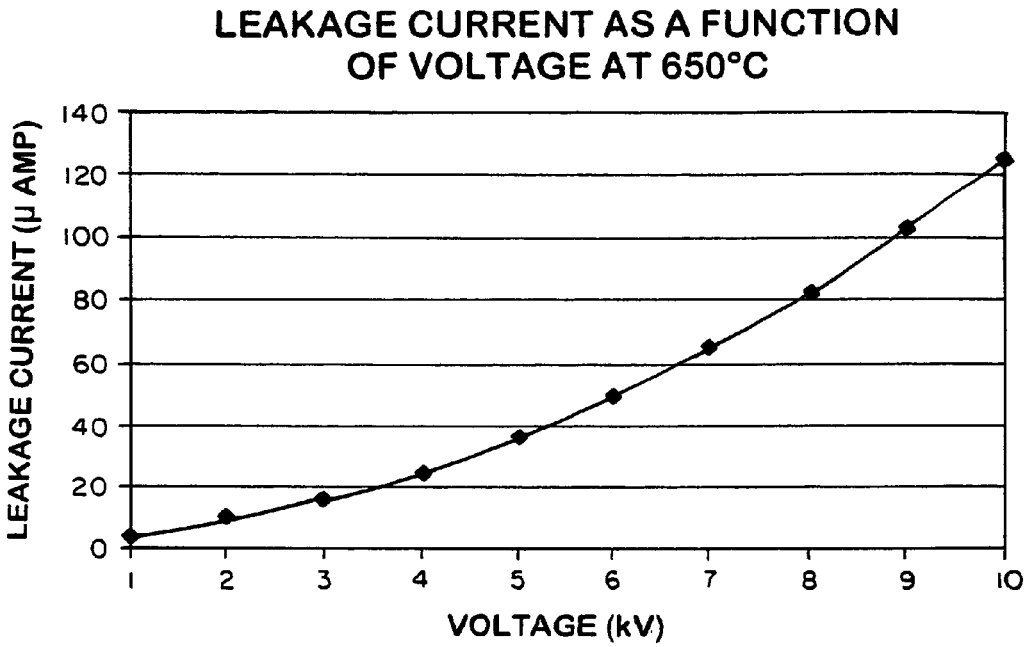
FIG. 3 is a graph of measured leakage current v. voltage for an embodiment of the ICW.

The outer diameter of the microwire was 89 $\mu$m. The inner diameter of the cladding was 100 $\mu$m. The cladding was 130 $\mu$m thick, resulting in an outer cladding diameter of 360 $\mu$m. The wire was heated to 650° C. and subjected to 10,000 V for 30 minutes without dielectric breakdown. The wire also performed for one hour at 840° C. and 5000 V. The electrical tests were done by wrapping an exposed conducting wire around the ICW and placing both wires in a furnace. A high voltage was applied to the exposed wire while the ICW was grounded. The leakage current through the ICW was measured. A graph of the measured leakage current as a function of applied voltage is shown in FIG. 3. There was no voltage breakdown through the cladding.

The bend radius of the wire was 0.0625 in. This was demonstrated by bending the wire by 90° around a ⅛ inch post. The bent wire did not break.

EXAMPLE 2

Copper-silica wire—A wire similar to that of Example 1 was made with a thinner cladding. The outer diameter of the cladding was 200 $\mu$m. The bend radius of the wire was less than 0.0625 in.

EXAMPLE 3

Platinum-silica wire—An ICW composed of a platinum microwire and a silica cladding was made by feeding a fused silica tube (25 mm outer diameter, 12.5 mm inner diameter) into a high temperature furnace and heated to greater than about 1600° C. The draw speed was set to reduce the inner diameter of the tube to about 100 $\mu$m. The platinum microwire was then inserted into the thinnest part of the tube. The draw speed was then slightly increased to reduce the inner diameter. The microwire contacted the tube, such that the tube grabbed the wire and pulled it through the furnace with the tube. The draw speed was then slightly increased to create a gap between the microwire and the cladding. The ICW was 18 inches long. The outer diameter of the microwire was 100 $\mu$m. The inner diameter of the cladding was 110$\mu$m.

EXAMPLE 4

Molybdenum wire in fused silica—A continuous length of ICW composed of a molybdenum microwire in a fused synthetic silica cladding was made in a draw tower by a process similar to Example 3. The outer diameter of the wire was about 127 microns, the inner diameter of the cladding was about 150 microns, and the outer diameter of the cladding was about 280 microns. A continuous length of 600 meters was spooled before the ICW was cut intentionally. The process could have continued until all of the wire and tubing were consumed. This could produce continuous lengths of up to 4,000 meters or more. The bend radius of the ICW was as small as 2 mm. The ICW did not break down at 10,000 volts at a temperature of 655° C. for 30 minutes and 5,000 volts at 1000° C. for 30 minutes.

What is claimed is:

1. An insulated conducting wire comprising:

a metal microwire having an outer diameter; and an inorganic cladding having an inner diameter;

wherein the microwire is positioned within the cladding;

wherein the outer diameter of the microwire is at least about 2 microns less then the inner diameter of the cladding;

wherein the insulated conducting wire is substantially free of bonding between the microwire and the cladding.

2. The insulated conducting wire of claim 1, wherein the insulated conducting wire comprises at least one portion that is at least 30 cm long that is free of bonding between the microwire and the cladding.

3. The insulated conducting wire of claim 1, wherein the insulated conducting wire comprises at least one portion that is at least 600 m long that is free of bonding between the microwire and the cladding.

4. The insulated conducting wire of claim 1, wherein the difference between the inner diameter of the cladding and the outer diameter of the microwire is from about 2 microns to about 40 microns.

5. The insulated conducting wire of claim 1, wherein the inner diameter of the cladding is from about 3 to about 290 microns.

6. The insulated conducting wire of claim 1, wherein the outer diameter of the microwire is from about 1 to about 250 microns.

7. The insulated conducting wire of claim 1, wherein the microwire comprises one or more metals selected from the group consisting of copper, silver, gold, platinum, tungsten, molybdenum, rhenium, rhenium/platinum alloy, high temperature metals, and alloys and composites thereof.

8. The insulated conducting wire of claim 1, wherein the cladding comprises one or more materials selected from the group consisting of fused silica, fused quartz, alumina, and a glass.

9. The insulated conducting wire of claim 1, wherein the cladding comprises one or more materials selected from the group consisting of $Ti^{4+}$ doped fused silica, $Ce^{4+}$ doped fused silica, and phosphorous doped silica.

10. The insulated conducting wire of claim 1, wherein the cladding comprises one or more materials selected from the group consisting of a doped glass and $F^-$ doped silica.

11. The insulated conducting wire of claim 1, further comprising a coating over the cladding.

12. The insulated conducting wire of claim 11, wherein the coating comprises one or more materials selected from the group consisting of polyimide, a polymer, an organic coating, and an inorganic coating.

13. A decoy towline comprising the insulated conducting wire of claim 1.

14. The insulated conducting wire of claim 1;

wherein the insulated conducting wire is flexible; and wherein the inner diameter of the cladding is from about 3 to about 290 microns.

15. The insulated conducting wire of claim 14, wherein the insulated conducting wire is at least about 600 meters long.

16. The insulated conducting wire of claim 1, where the insulated conducting wire is a general purpose insulated conducting wire.

17. The insulated conducting wire of claim 1, where the insulated conducting wire has the properties of being at least about 30 centimeters in length and being capable of conducting current while subjected to a potential of at least about 1000 V and a temperature of at least about 500° C. without dielectric breakdown.

18. The insulated conducting wire of claim 17, wherein the insulated conducting wire has a bend radius at room temperature of about 0.0625 inches or below.

19. The insulated conducting wire of claim 1, wherein the wire is capable of conducting current while subjected to a potential of at least about 5000 V and a temperature of at least about 1,000° C. without dielectric breakdown.

20. The insulated conducting wire of claim 19, wherein the insulated conducting wire has a bend radius at room temperature of about 0.0625 inches or below.

21. The insulated conducting wire of claim 1, wherein the wire is capable of conducting current while subjected to a potential of at least about 10,000 V and a temperature of at least about 650° C. without dielectric breakdown.

22. The insulated conducting wire of claim 21, wherein the insulated conducting wire has a bend radius at room temperature of about 0.0625 inches or below.

23. The insulated conducting wire of claim 1, wherein the microwire comprises platinum and the wire is capable of conducting current while subjected to a potential of at least about 1000 V and a temperature of at least about 1500° C. without dielectric breakdown.

24. The insulated conducting wire of claim 23, wherein the insulated conducting wire has a bend radius at room temperature of about 0.0625 inches or below.

25. The insulated conducting wire of claim 1, wherein the microwire comprises a surface having a melting point higher than the softening temperature of the cladding.

26. A process of making an insulated conducting wire, comprising the steps of:

providing a metal microwire having a surface and an outer diameter;

providing an inorganic tube having an inner diameter larger than the outer diameter of the microwire;

drawing the tube through a heating zone at draw process parameters such that the inner diameter of the drawn portion of the tube is reduced;

inserting the microwire into the drawn portion of the tube, whereby the drawn portion of the tube becomes a cladding around the microwire; and adjusting the draw process parameters such that the inner diameter of the cladding is larger than the outer diameter of the microwire, the surface of the microwire is not melted, and the microwire and the cladding are not in contact with each other under thermal conditions that would cause bonding between the microwire and the cladding.

27. The process of claim 26, further comprising the step of maintaining the draw process parameters of the adjusting step such that a continuous length of insulated conducting wire is produced that is free of bonding between the microwire and the cladding.

28. The process of claim 26, wherein drawing step comprises reducing the inner diameter to about the same size as the outer diameter.

29. The process of claim 26, wherein the inserting step comprises contacting the microwire to the inside of the drawn tube by adjusting the draw process parameters to further reduce the inner diameter of the drawn portion of the tube.

30. The process of claim 26, wherein the microwire comprises a leader.

31. The process of claim 30, wherein the leader is attached to the microwire during the process.

32. The process of claim 26, wherein the difference between the inner diameter of the cladding and the outer diameter of the microwire is from about 2 microns to about 40 microns.

33. The process of claim 26, wherein the inner diameter is from about 3 to about 290 microns.

34. The process of claim 26, wherein the outer diameter is from about 1 to about 250 microns.

35. The process of claim 26, wherein the microwire comprises one or more metals selected from the group consisting of copper, silver, gold, platinum, tungsten, molybdenum, conductors, and alloys thereof.

36. The process of claim 26, wherein the cladding comprises one or more materials selected from the group consisting of fused silica, fused quartz, alumina, and a glass.

37. The process of claim 26, wherein the cladding comprises one or more materials selected from the group consisting of $Ti^{4+}$ doped fused silica, $Ce^{4+}$ doped fused silica, and phosphorous doped silica.

38. The process of claim 26, wherein the cladding comprises one or more materials selected from the group consisting of a doped glass and $F^{-}$ doped silica.

39. The process of claim 26, further comprising the step of placing a coating over the cladding.

40. The process of claim 39, wherein the coating comprises a one or more materials selected from the group consisting of polyimide, polymer, organic coating, and inorganic coating.

* * * * *